US005127749A

United States Patent [19]

Tiano, Jr. et al.

[11] Patent Number: 5,127,749

[45] Date of Patent: Jul. 7, 1992

[54] METHOD OF REPAIRING PRINTHEADS AND PRODUCT THEREOF

[75] Inventors: John A. Tiano, Jr., Toms River; Michel Vallet, Pt. Pleasant; Joseph L. Costa, Brielle, all of N.J.

[73] Assignee: Depot America, Inc., Wall, N.J.

[21] Appl. No.: 719,024

[22] Filed: Jun. 21, 1991

[51] Int. Cl.[5] ..... B41J 2/265

[52] U.S. Cl. ..... 400/124; 29/402.06; 29/402.18

[58] Field of Search ..... 400/124; 101/93.05; 29/402.04, 402.06, 402.07, 402.18

[56] References Cited

U.S. PATENT DOCUMENTS

| | | | |
|---|---|---|---|
| 3,927,751 | 12/1975 | Juvet | 400/124 |
| 3,991,870 | 11/1976 | McIntosh | 400/124 |
| 4,890,375 | 1/1990 | Browning | 29/402.18 |

FOREIGN PATENT DOCUMENTS

| | | | |
|---|---|---|---|
| 126171 | 11/1984 | European Pat. Off. | 29/402.18 |
| 166065 | 10/1983 | Japan | 400/124 |
| 11257 | 1/1984 | Japan | 400/124 |
| 51462 | 3/1987 | Japan | 400/124 |
| 118265 | 5/1988 | Japan | 400/124 |
| 1303352 | 4/1984 | U.S.S.R. | 29/402.06 |

*Primary Examiner*—Edgar S. Burr

*Assistant Examiner*—J. R. Keating

*Attorney, Agent, or Firm*—Lerner, David, Littenberg, Krumholz & Mentlik

[57] ABSTRACT

A method of repairing a spent printhead or printhead subassembly and a repaired printhead or printhead subassembly made in accordance with such method is disclosed. The method includes the steps of removing the print pins from the spent printhead or printhead subassembly, removing at least a portion of the nose section in the area of the print pin holes of the spent printhead or printhead subassembly, filling at least a portion of such removed portion of the nose section with a casting material, inserting guide wires into the print pin holes in the nose section and permitting the casting material to at least partially cure to form new print pin holes. Also disclosed is a printhead or printhead subassembly repaired from a spent printhead having original print pin holes, the repaired printhead having a first section which includes a plurality of original print pin holes and a second section which includes a plurality of repaired print pin holes, the original print pin holes and repaired print pin holes being in alignment so as to form a plurality of composite print pin holes in the nose section, and a plurality of print pins arranged in the plurality of composite print pin holes so as to be selectively extendable beyond the print surface with the guidance of the repaired print pin holes of the second section.

60 Claims, 3 Drawing Sheets

METHOD OF REPAIRING PRINTHEADS AND PRODUCT THEREOF

BACKGROUND OF THE INVENTION

The present invention relates generally to printheads for business machines, and more particularly to a method of repairing spent or worn printheads and the product thereof, thereby obviating the need to purchase a new printhead.

Printheads of many types are available for use with electronic printers such as those employed in electronic cash registers, automatic teller machines or other business machines. In many cases, the printheads employed in such machines are of the dot-matrix variety. Such printheads effect the dot-matrix symbol or character by selectively firing print pins which are longitudinally arranged within the printhead. It is noted that a printhead may include a printhead subassembly (nose piece), print pins, a roller guide, an armature, coils, springs, etc. An example of such a printhead subassembly is shown in FIG. 1, wherein the print pins can be seen in the void between the nose section and main body, as well as in FIG. 1A, wherein the longitudinal arrangement of the print pins can be seen in the cross-section. The print pins of such printheads are made of tungsten steel or other steel alloys.

Typically, the nose section of the printhead, or at least the print pin guide section thereof (preferably near the print surface), is ceramic, metallic or plastic depending upon the intended application of the printhead, an original manufacturer's specifications, etc. In many cases, a prefabricated guide section, referred to as a ruby guide, is employed in the nose section to facilitate the proper alignment of the print pins. Ruby guides are plate-like structures with guide holes therethrough for alignment with the print pin holes in the nose section. The plate-like structure would be secured in a cavity in the print surface of the nose section. The advantage to using such ruby guides is that they can be prefabricated from stronger and more durable materials than the plastics often used in the rest of many printheads.

As a result of extensive use, the print pin holes of many printheads, and in particular those made of plastics become worn from contact with the moving print pins. Such wear occurs primarily towards the exit end of the pin holes (print surface), i.e., the end towards which the print pins fire to print a symbol; though in many cases, such wear also occurs at the point of entry into the nose section. Thus, the wear could be extant through the entire length of the nose section or only at the print surface and the entry surface. FIG. 2 is a broken away cross-section of a nose section of a printhead, illustrating several print pin holes or shafts which are worn at the print surface of the nose section and at the entry surface which faces the main body in the void. The print pin holes in FIG. 2 are designed to be, for instance, circular in cross-section, as in FIG. 1, so as to align the pins for proper firing. FIG. 2 shows, albeit somewhat exaggerated in degree, that the material in and around each shaft has been worn from the movement of the respective steel print pins. It is instructive to note that a print pin hole could increase from, for instance, its original diameter of about 0.36 millimeters to a worn diameter of about 0.38 millimeters (at its widest point—usually at the entrance and exit thereof).

As a printhead becomes increasingly worn proximal to the print surface, the print pin holes do not provide the guidance required to ensure that the print pins fire from the nose section in the desired direction. For instance, in FIG. 2, the print pin holes or shafts are intended to guide print pins straight out of the print surface, i.e., at 90° thereto. Without such guidance, the print pins may not and most likely will not fire straight, but rather will stray from their intended path of movement. This is due not only to vibration transmitted to the printhead from its respective machine or printer, but also by reason of the forces and internal stresses associated with the firing of the flexible pins, and the sideward movement of the printer carriage across the platen.

Thus, when the print pin holes or shafts are worn in the above-discussed fashion, it is difficult to print the desired symbol or character with clarity. FIG. 2A shows the letter "I" as it might be printed with a worn printhead. Indeed, the symbols being printed with a worn printhead will become progressively more blurred, and eventually become more difficult to read than the letter "I" shown in FIG. 2A. Therefore, the quality of symbols or characters printed by such a printhead would be degraded, and perhaps become illegible altogether. A printhead whose quality is affected by reason of such wear on the print pin holes and shafts is said to have been "spent".

In addition to the nose section becoming worn, thereby debilitating the guidance to have been provided by the print pin holes or shafts, excessive use of a spent printhead could damage the print pins themselves. That is, the pins might fire without proper guidance and may hit an obstruction which causes a print pin to bend or break.

Once a printhead is spent in the manner described above, it must be replaced. Since new printheads from the original or other manufacturer are quite expensive, there is a considerable market for repaired printheads. There currently exist some effective methods of repairing spent printheads which fire straight from the nose section of the printhead, i.e., where all print pins fire parallel to one another from parallel print pin holes or shafts at a 90° angle to the print surface. One such method is the use of a prefabricated and readily available ruby guide which includes the pattern of the print pin holes or shafts. The prefabricated ruby guide is of a particular thickness and includes holes or shafts running through such thickness in the pattern of the print pin holes in the nose section of the printhead. Thus, the material of the nose section of the printhead is removed from the print surface to a depth equal to the thickness of the replacement ruby guide (and in the specific shape of the replacement ruby guide). The ruby guide is then glued in the cavity formed in the nose section, whereby the holes of the replacement ruby guide would be aligned with the print pin holes of the nose section.

However, the use of prefabricated ruby guide is limited for many reasons. For instance, a prefabricated ruby guide may not be available for the printhead to be repaired or for the particular hole pattern of the printhead to be repaired. By way of example only, ruby guides are not available for printheads which include at least some print pin holes or shafts which extend at angles to one another such that at least some print pins disposed therein fire at angles to one another. One such printhead is IBM's Model No. 4683 for use in electronic cash registers. As those skilled in the art readily understand, it would be most difficult to prefabricate a ruby guide which would include a hole pattern to match the angled hole pattern of such a printhead. In this context, it should be kept in mind that the print pin holes are approximately 0.36 millimeters or 0.014 inches in diameter, and to match the specific angles of each hole in a ruby guide would be time consuming, expensive and tedious; and is yet to be accomplished. Thus, it might not be cost effective to manufacture ruby guides with angled holes in the large volume required for repairing such printheads. Moreover, even apart from cost, it would be quite difficult to secure such ruby guides in precise alignment with the print pin holes as would be required to properly repair the printhead.

Even with printheads having parallel print pin holes which guide the firing of print pins at 90° to the print surface of the printhead, prefabricated ruby guides may not be available. Beyond expense, difficulty of manufacture and difficulty in application, another reason a prefabricated ruby guide might not be available for a particular printhead is that such a prefabricated ruby guide would only be good for a particular printhead. Therefore, each particular printhead would require its own ruby guide. Still further, although the original equipment manufacturer may have ruby guides readily available to it for use in constructing new printheads, such ruby guides might not be readily available to those in the business of repairing printheads.

On some printheads, it is also difficult to replace a ruby guide or use a ruby guide after removing material since there would not be enough space for the ruby guide on the print surface of the printhead. That is, there would not be enough material around the replacement ruby guide to secure the same in place on the print surface of the printhead.

In addition, the printhead possesses several structural and operational characteristics which must be present in a repaired printhead as well to ensure proper and accurate printing. For instance, a ball bearing arrangement is operatively associated with the IBM 4683 printhead such that the ball bearing will ride along a guide below the platen surface as the printhead moves across the carriage of the printer. The ball bearing arrangement is positioned at a predetermined distance from the print surface to ensure proper character or symbol development by the printhead. In repairing a spent printhead, care must be taken to preserve the relationship between the ball bearing arrangement and the print surface (or the length of the printhead). Thus, with respect to the use of a ruby guide, a precise amount of material must be removed so that the ruby guide does not change the characteristics of the printhead.

Apart from purchasing a new printhead from the original equipment manufacturer, one of the only options for replacing many printheads is to mold an entirely new nose piece (printhead subassembly) for the printhead. However, this option is undesirable because of the cost of having a mold made for such a printhead subassembly. For example, a mold for the IBM 4683 printhead subassembly, is upwards of $50,000 to $70,000, and in some cases, with no guarantee as to whether the mold will be capable of molding a useable subassembly for the printhead. Moreover, just as with the ruby guides, the mold would be useful only for the particular printhead, and therefore each particular printhead would require its own subassembly mold.

Another option for repairing printheads is to remove the print pins, and replace them with larger print pins. This too is undesirable since it is a temporary measure at best, and may affect the integrity of the symbols printed by the print pins. Moreover, it is estimated that this technique only works to any extent about 30% of the time.

Recently, an attempt was made to repair a printhead without molding an entirely new nose piece. However this attempt permanently changed the character and integrity of the printhead, and more importantly, lasted only a short period of time. To the extent the technique employed in this attempt can be gleaned from the repaired printhead, it appears to have included the grinding of the print surface in the area of the holes in a lengthwise manner. A strip of plastic, which appeared to be considerably less than one millimeter in thickness, is glued on the ground-away area of the holes. The result, however, is that the strip of plastic is not flush with the print surface, but rather extends beyond the print surface. One of the reasons this might occur is that the thickness of the glue can not be controlled, and indeed may be thicker in one area of the strip of plastic than in another. It is not clear whether the strip of plastic included the hole pattern of the spent printhead or whether the holes were punched or drilled through after the strip of plastic was in place. In any event, the strip is relatively thin and flexible, and therefore it is quite probable that the original print pin holes which remain immediately below the strip of plastic may still be enlarged from having been worn by the original print pins. Thus, abraded material or other material can get behind the strip of plastic in the enlarged portions of the original print pin holes, causing a strip of plastic to flex upon the firing of the replacement print pins. It is thus noted that the strip of plastic is not the same as a ruby guide which is thicker and more durable than a thin strip of plastic.

It is also noted that in this technique it appears that the original print pins were used in the repaired printhead. Perhaps most significantly, the character of the printhead itself is changed by this technique. For example, the ball bearing rider which bears against a guide below the platen as the printhead is moved across the carriage must be of a particular distance from the print surface, as noted above. Since the addition of the strip of plastic is above or below the original print surface, the length of the printhead is greater or smaller, respectively, in that area, depending of course upon the amount of original material removed; and therefore the ball bearing arrangement must be re-aligned with respect to the strip of plastic or new length of the printhead. This, of course, adds tedious and time consuming steps to the repair process. Lastly, it is possible that the practicing of this technique could destroy the repairability of the printhead. That is, the repaired printhead may only last a month or two before failing, and it could not be repaired due to the permanent change in the printhead. Rather, a new printhead would have to be purchased after the failure of the repaired printhead.

Accordingly, to replace many printheads, and in particular those having at least some print pins which fire at angles to one another, the only viable option for a permanent replacement would be to purchase a new printhead. This could become extremely expensive for department store chains and other entities which may have thousands of electronic cash registers, all of which may have worn printheads requiring replacement within months of one another.

The above shortcomings make it clear that an improved method for repairing printheads which use print wire, firing at angles to one another or parallel to one another, and the resulting product thereof, are warranted. The present invention provides such a method and product thereof.

SUMMARY OF THE INVENTION

The present invention specifically relates to a method of reconstructing a spent printhead or printhead subassembly having a nose section with a print surface, a plurality of print pin holes and a plurality of print pins disposed in the print pin holes, including the steps of removing the print pins from the nose section of the printhead, removing at least a portion of the nose section in the area of the print pin holes so that at least a portion of the print surface is eliminated, filling at least a portion of the removed portion of the nose section with a casting material, inserting guide wires into the print pin holes in the nose section so that the guide wires are at least partially in the removed portion of the nose section, and permitting the casting material to at least partially cure so as to replace at least a portion of the removed portion of the nose section and to thereby form new print pin holes.

The present invention also relates to a printhead or printhead subassembly repaired in accordance with the above method.

The present invention further relates to a printhead or printhead subassembly repaired from a spent printhead, which repaired printhead includes a nose section having a print surface, a first section and a second section, the second section including a plurality of repaired print pin holes, the first section including a plurality of original print pin holes which are in alignment with the repaired print pin holes to form a plurality of composite print pin holes in the nose section for housing a plurality of print pins, wherein the first section was part of the spent printhead and wherein the second section is not a prefabricated and readily available guide member, and a plurality of print pins arranged in the plurality of composite print pin holes to be selectively extendable beyond the print surface for printing, whereby the second section of the nose section provides guidance for the proper firing of the print pins.

It is thus an object of the present invention to provide a method of repairing a spent printhead of virtually any type.

It is another object of the present invention to provide a repaired printhead or printhead subassembly which causes the print pins thereof to fire in a manner substantially similar to the firing of print pins of a new printhead or printhead subassembly of the same type as the repaired printhead or printhead subassembly.

It is a further object of the present invention to provide a method of repairing a spent printhead or to provide a repaired printhead, wherein at least a portion of the print pin holes of such spent printhead or repaired printhead are at angles to one another such that print pins disposed therein fire at angles to one another.

The above described method may also include in accordance with the present invention the steps of removing the guide wires from the print pin holes of the nose section and the new print pin holes in the casting material, and inserting print pins into the print pin holes of the nose section and the new print pin holes in the casting material. Further, the casting material may be placed into at least a portion of the removed portion of the nose section after the guide wires are inserted into the removed portion of the nose section such that the casting material will surround the guide wires without the guide wires bending or becoming otherwise damaged. Still further, the above-described method may include the step of grinding any excess material on or around the print surface so that the repaired printhead is substantially similar to a new printhead of the same type as the spent printhead and so that the repaired printhead is commercially presentable.

The print pins inserted into the print pin holes of the nose section and the print pins in the casting material are desirable new print pins which have a larger cross-section than the removed print pins. Such new print pins can be longer than the removed print pins such that the above-described method would include the step of trimming the new print pins. In this context, the guide wires are desirably larger in cross-section than the removed print pins and larger in cross-section than the new print pins.

The method also contemplates the removal of at least a portion of the nose section in the area of the print pin holes such that at least a portion of the print surface is eliminated. Thus, instead of removing material from one side of the printhead subassembly to the other without disturbing the print surface at all, i.e., boring a hole from one side to the other under the print surface, a portion of the print surface may be removed by forming a groove from one side of the printhead to the other or boring a hole in the center of the print surface in the area of the print pin holes.

The method further contemplates the provision of at least one undercut to facilitate the anchoring of the casting material in the removed portion of the nose section.

An intermediate step of aligning guide wires in the removed portion of the nose section to correspond with the alignment of print pin holes of a new printhead is further contemplated in this regard, a guide wire positioning tool may be employed to properly align and position the guide wires, while the casting material at least partially cures. The guide wire positioning tool can then be removed and the guide wires can be retracted before completely filling the removed portion of the nose section. The guide wires can then be pushed through the additional casting material as the entire nose section of the printhead under repair is placed in a nose section mold which emulates the shape and size of a nose section of a new printhead subassembly.

BRIEF DESCRIPTION OF THE DRAWINGS

The above and other objects of the present invention will become apparent, as will a better understanding of the concepts underlying the present invention, by reference to the description which follows when taken in conjunction with the accompanying drawings in which.

DETAILED DESCRIPTION OF THE INVENTION

Figure 2A:
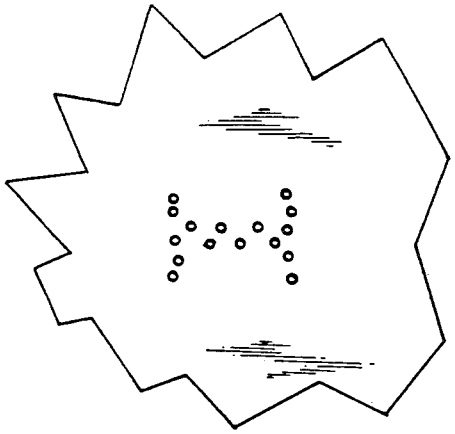
FIG. 2A is the letter "I" as it might be printed by the spent printhead subassembly in FIG. 2.
Figure 2:
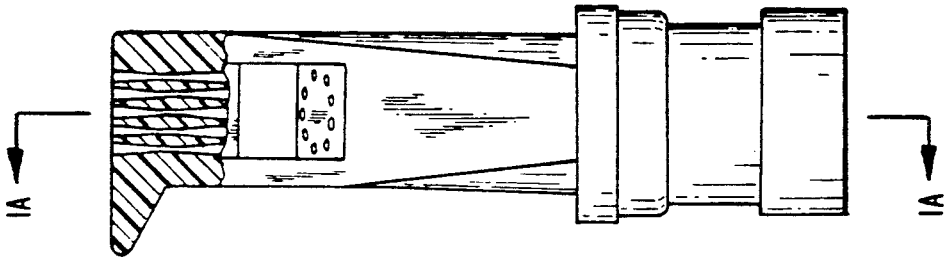
FIG. 2 is a right side elevational view in partial cross-section, of a printhead subassembly having worn print pin holes.

Referring to the figures, FIGS. 3-7A illustrate the repair of a spent printhead subassembly generally designated as 10. The spent printhead subassembly 10 shown in these figures includes randomly worn print pin holes similar to those shown in the printhead subassembly of FIG. 2; however, at least a portion of the print pin holes in the spent printhead subassembly 10, generally designated as 12, are at angles to one another such that at least a portion of the print pins arranged in the print pin holes 12 will fire at angles to one another (the angles shown are representative only as different printheads will have different angles between the print pins). It is imperative to note that the present invention is not limited to the method of repair or repaired printhead subassemblies of the type shown in FIGS. 3-7A. Rather, the present invention is applicable to printhead subassemblies in which the print pins fire parallel to one another at an angle or 90° to the print surface.

Figure 1A:
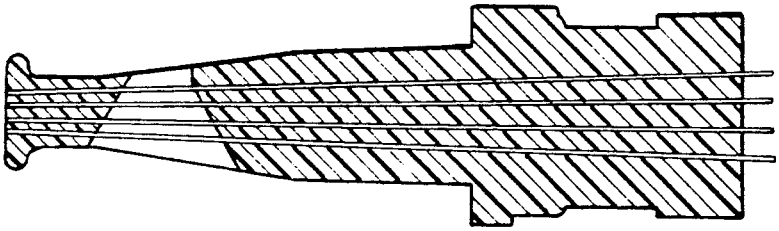
FIG. 1A is a cross-sectional rear elevational view of the dot matrix printhead subassembly shown in FIG. 1.
Figure 1:
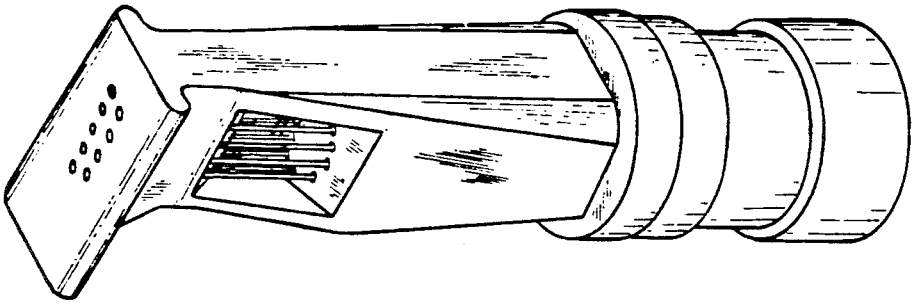
FIG. 1 is a perspective view of a dot matrix printhead subassembly, illustrating an example of a printhead which can be repaired in accordance with the present invention.
Figure 3:
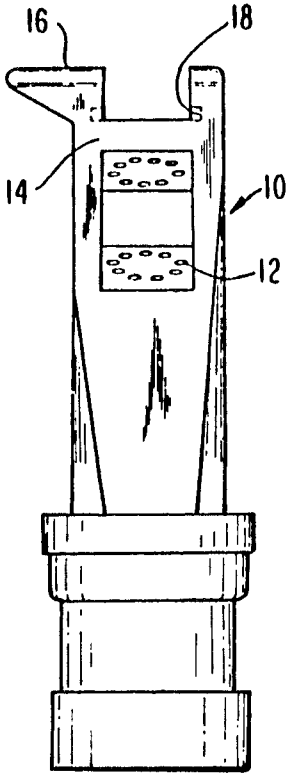
FIG. 3 is a right side elevational view of a spent printhead subassembly from which a portion of the nose section has been removed.

FIG. 3 shows the spent printhead subassembly 10 after the print pins have been removed, thereby exposing the original print pin holes 12 which extend upwardly from the bevelled entry surface of the nose section 14. The original print pin holes of the spent printhead subassembly 10 normally extend towards and open at the print surface 16 so that print pins could be arranged therein so as to be extendable beyond the print surface 16 (see FIGS. 1, 1A & 2). However in FIG. 3, the material of the spent printhead subassembly (plastic) adjacent the print surface 16 has been removed by, for example, cutting, grinding, etc. Therefore, a portion of each original print pin hole 12 has been removed from the spent printhead subassembly 10.

It is noted that since the new print pin holes to be formed by the casting material, discussed in detail below, will provide much of the guidance the new print pins will require for proper printing, a sufficient amount of material should be removed from the spent printhead subassembly 10. However, it may not be possible to remove all of the worn portions of the original print pin holes 12 since such wear could have infected the entire nose section 14 (See FIG. 2). It has been found that removing material to a depth of approximately 2 millimeters has been sufficient to provide new print pin holes which will sufficiently guide the print pins during firing. It is also noted that the remaining portions of each original print pin hole 12 may, in some cases, also help the guiding of the new print pins, but the integrity of the new print pin holes will ensure proper guidance irrespective of the damage or wear at the bevelled entry surface of the nose section 14.

In cutting or grinding away the material of the nose section 14, it is desirable to form an undercut 18 in at least one section of the cut out portion. Such an undercut can be in the medial area of the cut out portion, on one side or from one side to the other. FIGS. 3, 4, 6 and 7 show a medial undercut. This prevents the possibility of side to side movement of the casting material. This undercut 18 will help "anchor" the cement or casting material used to fill the removed portion as explained below. In this regard, it is noted that the undercut need not be at the bottom of the cut out portion, but may be anywhere along its depth so long as it is deep enough so that the material above it (of the nose section 14) is strong enough to remain intact.

Although the removed section shown in the preferred embodiment is made form one side to the other of the printhead subassembly 10, the present invention comtemplates the removal of any of the material of the nose section 14 so long as sufficient alignment and guide holes can be provided int he removed area. Therefore, instead of cutting from one side to the other, it is possible to bore a hole within the boundaries of the print surface 16 such that a portion of the print surface 16 remains at all points around the hole. It is also possible to bore a hole from one side of the nose section 14 to the other side without disturbing the print surface 16 at all; i.e., below the print surface 16. This may, however, be more difficult than the preferred embodiment, or even undesirable since the guidance of the print pins is preferably at the print surface 16. If a hole is bored from one side to the other below the print surface 16, worn portions of the print pin holes will remain at the print surface 16.

Once the material has been removed from the nose section 14, guide wires are inserted through the original print holes 12. Preferably, the guide wires 20 are slightly larger than the print pins to be used in the final repaired printhead subassembly. As an example, the guide wires can be approximately 0.01 to 0.02 millimeters larger than the print pins to be used in the repaired printhead subassembly. Thus, again as an example only, the guide wires could be approximately 0.36 to 0.37 millimeters in diameter with respect to a print pin which is approximately 0.35 millimeters in diameter.

As will become apparent, it is desirable to cause the guide wires to extend, at least initially, at least into the removed area of the nose section 14, and even beyond the print surface 16. Prior to pushing the guide wires 20 to this extent, it may be desirable to partially fill the removed portion of the nose section 14 with a cement or casting material 22. In this manner, the guide wires 20 will not be bent or otherwise damaged in placing the cement in the removed portion of the nose section 14.

The cement or casting material used to fill the removed portion of the nose section 14 can be virtually any type of material as long as it is somewhat moldable and will cure so as to be hard and durable. It is also preferable that the material be capable of bonding to the material of the nose section 14. One example of such material is Dentsply Triad cement, a casting material typically used in dentistry.

Figure 8A:
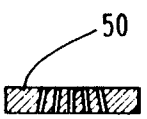
FIG. 8A is a cross-sectional right side elevational view of the guide wire positioning tool shown in FIG. 8.
Figure 8:
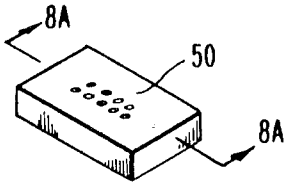
FIG. 8 is a perspective view of the guide wire positioning tool.

Once the cement 22 partially fills the removed portion of the nose section 14, the guide wires 20 can be pushed through the cement 22 (which has not yet hardened) and beyond the print surface 16. Although the alignment of the guide wires 20, with respect to one another and as a group, is quite accurate by reason of the original print pin holes 12, it is desirable to ensure even more accuracy in such alignment and positioning of the guide wires 20. Accordingly, a guide wire positioning tool can be employed to ensure the utmost accuracy. Such a guide wire positioning tool is shown in FIG. 8 and FIG. 8A.

The guide wire positioning tool 50 should be made with reference to the print pin hole pattern on the print surface of a new printhead subassembly of the type being repaired. The guide wire positioning tool 50 can be formed by replacing the print pins of such a new printhead subassembly with guide wires, pushing the guide wires beyond the print surface of the new printhead subassembly, and forming the guide wire positioning tool 50. The guide wire positioning tool 50 can be made of the same cement or casting material as the cement 22, or any other suitable material. It is only important that the guide wire positioning tool 50 provide the proper print pin hole pattern to properly align the guide wires 20.

Figure 4:
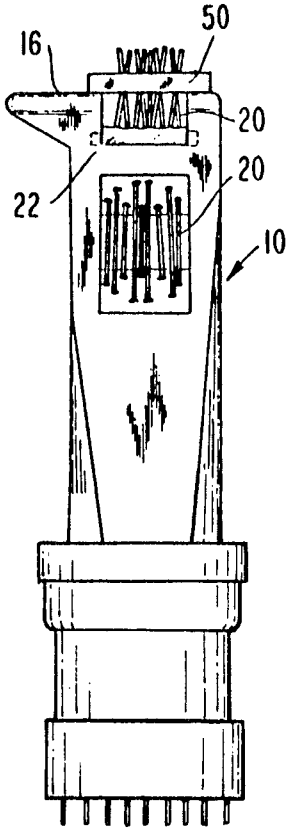
FIG. 4 is a right side elevational view of the spent printhead subassembly being repaired illustrating in particular the alignment of the guide wires and the partial filling of the cavity formed by the removal of a portion of the nose section.

Thus, in FIG. 4, the guide wires 20 have been pushed through the not yet hardened cement 22 and beyond the print surface 16 and into the guide wire positioning tool 50. It is now preferable to allow the cement 22 to at least partially cure so as to form a portion of the new print pin holes. Once the cement 22 is partially cured, the guide wire positioning tool 50 can be removed, and the guide wires 20 can be retracted below the top surface of the cement 22. The partially repaired print pin holes can now serve to properly align the guide wires 20.

It might be desirable to lubricate the guide wires 20 prior to insertion into the printhead subassembly 10. In the alternative, the guide wires 20 can be made of tungsten steel with a Teflon coating. Such lubrication or the Teflon coating will facilitate the removal of the guide wires 20 from the cement 22.

With the guide wires 20 in a retracted position, additional cement 22 can be used to fill completely the removed portion of the nose section 14 and to provide additional cement 22 at least in the area through which the new print pin holes will be formed on the print surface 16. Again, with the guide wires 20 in a retracted position, the guide wires 20 will not become bent or otherwise damaged when packing the additional cement 22 in the void in the nose section 14.

Figure 9A:
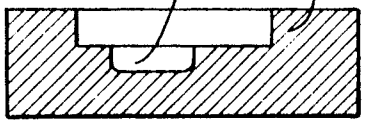
FIG. 9A is a cross-sectional right side elevational view of the nose section mold shown in FIG. 9.
Figure 9:
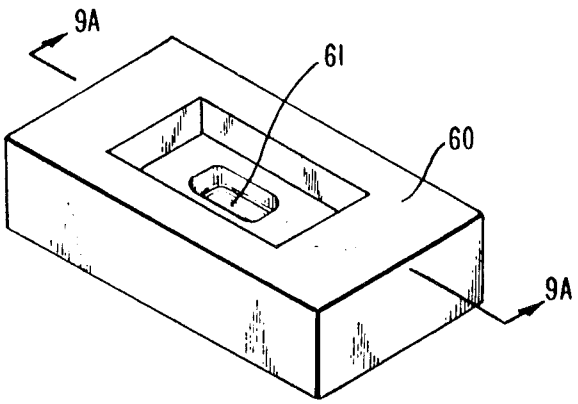
FIG. 9 is a perspective view of the nose section mold.

Once enough cement 22 has been packed into the removed portion of the nose section 14, the entire printhead subassembly 10 is inverted and placed into a mold 60. The mold 60 is shown in FIG. 9 and FIG. 9A, and can be made with reference to the nose section of a new printhead subassembly of the same type as the printhead being repaired and/or with reference to the specifications for such new printhead subassembly. The mold 60 provides a cavity having the size and shape of a nose section of a new printhead of the type being repaired. In addition, a secondary cavity is preferably formed below the nose section cavity. This secondary cavity, generally designated as 61 is in the area of the print pin holes, and is intended to form a mass of material above the print surface of the repaired printhead. This mass of material will be removed, as is explained below, in cleaning up the print surface of the repaired printhead.

It may be desirable to lubricate the primary and secondary cavities of the mold 60 to facilitate removal of the printhead 10, and in particular to prevent the cement 22 from adhering in any way to the mold.

Figure 5:
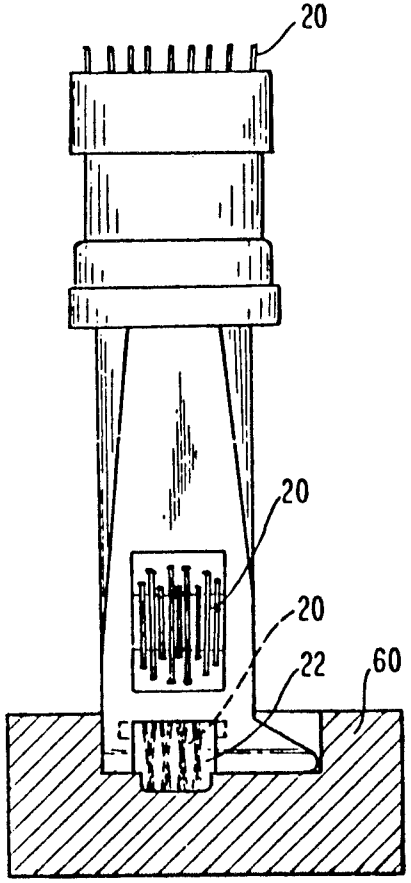
FIG. 5 is an inverted right side elevational view of the spent printhead subassembly being repaired in the nose section mold.

FIG. 5 shows the printhead subassembly 10 in the inverted position in the mold 60. Once in this position, the printhead subassembly itself is pushed downward to ensure that it is against the bottom of the primary cavity of the mold 60. The guide wires 20 are then forced downwardly through the cement 22 until they hit the bottom of the secondary cavity of the mold 60.

The cement 22 is then permitted to at least partially cure, and may be subjected to an ultraviolet light or halogen light, or any other light source, to facilitate the curing of the cement 22. The curing of the cement 22 by ultraviolet rays can be conducted with the guide wires 20 removed from the printhead 10 (after forming the holes through partial curing) or with the guide wires 20 in place, though the latter is preferred.

Figure 6:
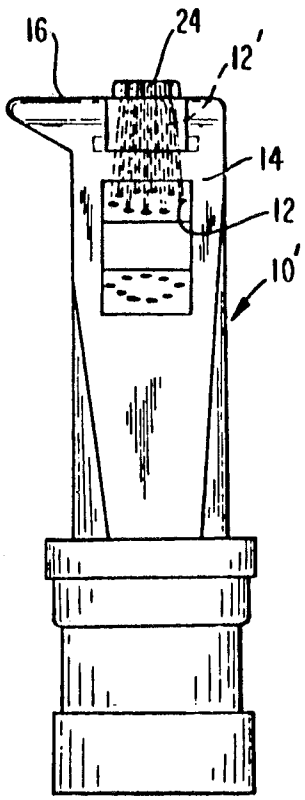
FIG. 6 is a right side elevational view of the partially repaired printhead subassembly after the guide wires have been removed.

FIG. 6 thus shows the almost completely repaired printhead 10' wherein the guide wires 20 have been removed and the mass of material 24 remains above the print surface 16. Also shown are the original print pin holes 12 and the new print pin holes 12' which have been formed in the material and the cement 22.

The mass of material 24 can now be cut or ground so that the print surface 16 is generally flat surface across the top of the new nose section 14'. The grinding and cleaning up of the entire surface is done to provide clean print pin holes 12' at the print surface 16 and to make the nose section commercially acceptable. The mass of material 24 is thus ground down in precision relationship to a new printhead of the same type.

Once the new nose section 14' has been cleaned up, new print pins 26 are inserted into the printhead and into the new nose section 14' so that the print pins 26 are in substantially the same position as print pins of a new printhead of the same type as the printhead which has been repaired. This could be flush to the new print surface 16' or slightly above the new print surface 16'. It is noted that the new print pins 26 are somewhat larger than the print pins which have been removed prior to repair. Thus, the original print pins might have been 0.33 millimeters in diameter, while the replacement or new print pins are 0.35 millimeters in diameter.

To summarize, the preferred method includes the steps of milling or removing material from the nose section of the printhead subassembly, inserting guide wires through the nose and into the wire positioning tool, applying a small amount of casting material in and around the guide wires at the bottom of the removed section, allowing the casting material to at least partially cure, removing the pins from the positioning tool to a point flush with the bottom of the removed portion, packing the removed portion with casting material, inserting the nose section into the nose section mold, pushing the pins through the casting material to the bottom of the nose section mold, removing the mold, permitting the casting material to at least partially cure, removing the guide wires, inserting new print pins, reassembling the printhead subassembly with the roller guides, armature, coils, springs, etc. to form the repaired printhead.

Figure 7A:
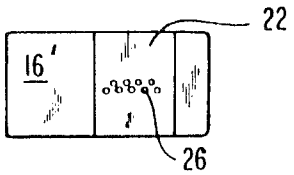
FIG. 7A is a top plan view of the repaired printhead subassembly shown in FIG. 7.
Figure 7:
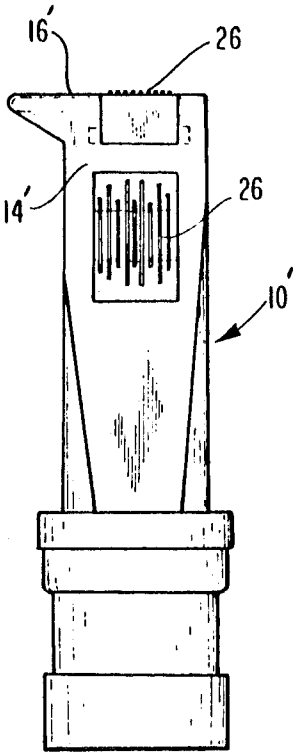
FIG. 7 is a right side elevational view of a repaired printhead subassembly.

FIGS. 7 and 7A show the fully repaired printhead 10', including the new print pins 26. As noted above, it is the repaired print pin holes 12' which will ensure proper guidance of the new print pins 26 during the printing process. This repaired printhead 10' can be used in any of the printing machines in which a new printhead of the same type can be employed. However, the difference in cost is substantial. Still further, since the cement used to fill the removed portion of the nose section 14 might be more durable than the material of which the nose section 14 is originally made, the repaired printhead 10' may even last longer than an original printhead.

Thus, while the foregoing description and figures illustrate one preferred embodiment of the method and product in accordance with the present invention, it should be appreciated that certain modifications could be made and are encouraged to be made in the materials and techniques of the disclosed embodiment without departing from the spirit and scope of the present invention which is intended to be captured by the claims set forth immediately below. For instance, not all of the steps set forth above need be employed to practice the inventive concepts underlying the present invention. In addition, the steps set forth above need not be employed in he particular sequence discussed above, or even in the claims unless otherwise specified.

WHAT IS CLAIMED IS:

1. A method of repairing a spent printhead having a nose section with a print surface, a plurality of print pin holes extending longitudinally from the print surface through the nose section, at least a portion of the print pin holes being worn at the print surface, and a plurality of print pins arranged in the print pin holes to be selectively extendable beyond the print surface for printing, said method comprising the steps of:

a. removing the print pins from the nose section of the spent printhead, thereby exposing the plurality of print pin holes at the print surface;

b. removing at least a portion of the nose section in the area of the print pin holes;

c. filling at least a portion of the removed portion of the nose section with a casting material;

d. inserting guide wires into the print pin holes in the nose section such that the guide wires are at least partially in the removed portion of the nose section; and e. permitting the casting material to at least partially cure so as to replace at least a portion of the removed portion of the nose section, whereby the casting material and the guide wires together form new print pin holes.

2. The method in claim 1, including the steps of removing the guide wires from the print pin holes of the nose section and the new print pin holes in the casting material, and inserting print pins into the print pin holes of the nose section and the new print pin holes in the casting material

3. The method in claim 2, wherein the casting material is placed into at least a portion of the removed portion of the nose section after the guide wires are inserted into the removed portion of the nose section such that the casting material surrounds the guide wires without the guide wires bending or becoming otherwise damaged.

4. The method in claim 3, including the step of grinding any excess material on or around the print surface such that the repaired printhead is substantially similar to a new printhead of the same type as the spent printhead.

5. The method in claim 2, wherein the print pins are new print pins having a larger cross-sectional size than the removed print pins.

6. The method in claim 5, wherein the new print pins are longer than the removed print pins, extending beyond the print surface, and including the step of trimming the new print pins so that the new print pins are in a position substantially identical to a new printhead of the same type as the spent printhead.

7. The method in claim 2, wherein the at least a portion of the nose section in the area of the print pin holes is removed such that at least a portion of the print surface is eliminated.

8. The method in claim 1, wherein the guide wires are larger in cross-section than the removed print pins.

9. The method in claim 8, wherein the guide wires are circular in cross-section, the print pins are new print pins which are circular in cross-section and are larger in cross-section than the removed print pins, and the guide wires are larger in cross-section that the new print pins.

10. The method in claim 9, wherein the guide wires are inserted into the casting material and at least to the print surface of the nose section.

11. The method in claim 10, wherein the at least a portion of the nose section is removed such that at least one undercut is provided in the nose section so as to anchor the casting material in the removed portion of the nose section.

12. The method in claim 1, wherein the at least a portion of the nose section is removed such that at least one undercut is provided in the nose section so as to anchor the casting material in the removed portion of the nose section

13. The method in claim 1, including the step of aligning the guide wires in the removed portion of the nose section to correspond to the alignment of the print pin holes of a new printhead of the same type as the spent printhead.

14. The method in claim 13, wherein the guide wires are aligned by positioning partially in or above the removed portion of the nose section a guide wire positioning tool having guide wire receiving holes such that the guide wires are disposed in the guide wire receiving holes, the guide wiring positioning tool having been constructed with reference to the print pin hole pattern of a new printhead of the same type as the spent printhead.

15. The method in claim 14, wherein the removed portion of the nose section is first partially filled with the casting material and the guide wires are only then arranged in the removed portion of the nose section within the casting material, and including the steps of removing the guide wire positioning tool after the casting material has at least partially cured, placing additional casting material in the removed portion of the nose section, inserting the guide wires into the additional casting material, removing the guide wires from the print pin holes after the additional casting material has at least partially cured.

16. The method in claim 15, including the steps of providing a nose section mold made with reference to a new printhead of the same type as the spent printhead such that the nose section mold includes a cavity which substantially conforms to the shape and size of the nose section of a new printhead, placing the nose section mold over the nose section of the spent printhead so as to cover the casting material, forcing the guide wires towards the nose section mold until the guide wires contact the nose section mold, and removing the nose section mold.

17. The method in claim 16, wherein the casting material is Dentsply Triad cement, and including the step of curing the cement by subjecting the cement to ultraviolet or halogen light.

18. The method in claim 17, including the step of lubricating the nose section mold before placing the nose section mold over the nose section of the spent printhead.

19. The method in claim 18, including the step of forming with the nose section mold a mass of casting material in the area of the new print pin holes, said mass of material being above the print surface, and the step of grinding off the mass of material to ensure that the new print pin holes are clean.

20. The method in claim 1, wherein the casting material is Dentsply Triad cement, and including the step of curing the cement by subjecting the cement to ultraviolet or halogen light.

21. The method in claim 1, including either the step of injecting a lubricant into the area of the print pin holes of the spent printhead to facilitate the removal of the guide wires, or the step of lubricating the guide wires prior to inserting the same into the printhead.

22. The method in claim 1, wherein a portion of the nose section in the area of the print pin holes is removed to thereby form a cavity in the print surface, whereby the cavity is surrounded by the print surface.

23. The method in claim 1, wherein at least a portion of the print pin holes in the spent printhead are at an angle to one another such that the print pins in said at least a portion of the print pin holes fire at angles to one another.

24. The method in claim 23, including the steps of removing the guide wires from the print pin holes of the nose section and the new print pin holes in the casting material, and inserting print pins into the print pin holes of the nose section and the new print pin holes in the casting material.

25. The method in claim 23, wherein the guide wires are larger in cross-section than the removed print pins, and the new print pins are larger in cross-section than the guide wires.

26. The method in claim 23, including the step of grinding any excess material on or around the print surface such that the reconstructed printhead is substantially similar to a new printhead of the same type as the spent printhead.

27. A printhead repaired from a spent printhead having a nose section with a print surface, a plurality of print pin holes extending longitudinally from the print surface through the nose section, at least a portion of the print pin holes being worn at the surface, and a plurality of print pins arranged in the print pin holes to be selectively extendable beyond the print surface for printing, said repaired printhead being made by a method comprising the steps of:

a. removing the print pins from the nose section of the spent printhead, thereby exposing the plurality of print pin holes at the print surface;

b. removing at least a portion of the nose section in the area of the print pin holes;

c. filling at least a portion of the removed portion of the nose section with a casting material;

d. inserting guide wires into the print pin holes in the nose section such that the guide wires are at least partially in the removed portion of the nose section; and e. permitting the casting material to at least partially cure so as to replace at least a portion of the removed portion of the nose section, whereby the casting material and the guide wires together form new print pin holes.

28. The printhead in claim 27, including the steps of removing the guide wires from the print pin holes of the nose section and the new print pin holes in the casting material, and inserting print pins into the new print pin holes of the nose section and the new print pin holes in the casting material.

29. The printhead in claim 28, wherein the casting material is placed into at least a portion of the removed portion of the nose section after the guide wires are inserted into the removed portion of the nose section such that the casting material surrounds the guide wires without the guide wires bending or becoming otherwise damaged.

30. The printhead in claim 29, including the step of grinding any excess material on or around the print surface such that the repaired printhead is substantially similar to a new printhead of the same type as the spent printhead.

31. The printhead in claim 28, wherein the print pins are new print pins having a larger cross-sectional size than the removed print pins.

32. The printhead in claim 31, wherein the new print pins are longer than the removed print pins, extending beyond the print surface, and including the step of trimming the new print pins so that the new print pins are in a position substantially identical to a new printhead of the same type as the spent printhead.

33. The printhead in claim 28, wherein the at least a portion of the nose section in the area of the print pin holes is removed such that at least a portion of the print surface is eliminated.

34. The printhead in claim 27, wherein the guide wires are larger in cross-section than the removed print pins.

35. The printhead in claim 34, wherein the guide wires are circular in cross-section, the print pins are new print pins which are circular in cross-section and are larger in cross-section than the removed print pins, and the guide wires are larger in cross-section that the new print pins.

36. The printhead in claim 35, wherein the guide wires are inserted into the casting material and at least to the print surface of the nose section.

37. The printhead in claim 36, wherein the at least a portion of the nose section is removed such that at least one undercut is provided in the nose section so as to anchor the casting material in the removed portion of the nose section.

38. The printhead in claim 27, wherein the at least a portion of the nose section is removed such that at least one undercut is provided in the nose section so as to anchor the casting material in the removed portion of the nose section.

39. The printhead in claim 27, including the step of aligning the guide wires in the removed portion of the nose section to correspond to the alignment of the print pin holes of a new printhead of the same type as the spent printhead.

40. The printhead in claim 39, wherein the guide wires are aligned by positioning partially in or above the removed portion of the nose section a guide wire positioning tool having guide wire receiving holes such that the guide wires are disposed in the guide wire receiving holes, the guide wiring positioning tool having been constructed with reference to the print pin hole pattern of a new printhead of the same type as the spent printhead.

41. The printhead in claim 40, wherein the removed portion of the nose section is first partially filled with the casting material and the guide wires are only then arranged in the removed portion of the nose section within the casting material, and including the steps of removing the guide wire positioning tool after the casting material has at least partially cured, placing additional casting material in the removed portion of the nose section, inserting the guide wires into the additional casting material, removing the guide wires from the print pin holes after the additional casting material has at least partially cured.

42. The printhead in claim 41, including the steps of providing a nose section mold made with reference to a new printhead of the same type as the spent printhead such that the nose section mold includes a cavity which substantially conforms to the shape and size of the nose section of a new printhead, placing the nose section mold over the nose section of the spent printhead so as to cover the casting material, forcing the guide wires towards the nose section mold until the guide wires contact the nose section mold, and removing the nose section mold.

43. The printhead in claim 42, wherein the casting material is Dentsply Triad cement, and including the step of curing the cement by subjecting the cement to ultraviolet or halogen light.

44. The printhead in claim 43, including the step of lubricating the nose section mold before placing the nose section mold over the nose section of the spent printhead.

45. The printhead in claim 44, including the step of forming with the nose section mold a mass of casting material in the area of the new print pin holes, said mass of material being above the print surface, and the step of grinding off the mass of material to ensure that the new print pin holes are clean.

46. The printhead in claim 27, wherein the casting material is Dentsply Triad cement, and including the step of curing the cement by subjecting the cement to ultraviolet or halogen light.

47. The printhead in claim 27, including either the step of injecting a lubricant into the area of the print pin holes of the spent printhead to facilitate the removal of the guide wires, or the step of lubricating the guide wires prior to inserting the same into the printhead.

48. The printhead in claim 27, wherein a portion of the nose section in the area of the print pin holes is removed to thereby form a cavity in the print surface, whereby the cavity is surrounded by the print surface.

49. The printhead in claim 27, wherein at least a portion of the print pin holes in the spent printhead are at an angle to one another such that the print pins in said at least a portion of the print pin holes fire at angles to one another.

50. The printhead in claim 49, including the steps of removing the guide wires from the print pin holes of the nose section and the new print pin holes in the casting material, and inserting print pins into the print pin holes of the nose section and the new print pin holes in the casting material.

51. The printhead in claim 49, wherein the guide wires are larger in cross-section than the removed print pins, and the new print pins are larger in cross-section than the guide wires.

52. The printhead in claim 49, including the step of grinding any excess material on or around the print surface such that the reconstructed printhead is substantially similar to a new printhead of the same type as the spent printhead.

53. A printhead repaired from a spent printhead having original print pin holes, at least a portion of which are worn, said repaired printhead comprising a nose section having a print surface, said nose section of said repaired printhead being substantially similar in size and shape to a nose section of a new printhead of the same type as said repaired printhead, a first section and a second section, said second section including a plurality of repaired print pin holes, said first section including a plurality of original print pin holes which are in alignment with said plurality of repaired print pin holes to form a plurality of composite print pin holes in said nose section for housing a plurality of print pins, wherein said first section was part of the spent printhead and wherein said second section is not a prefabricated and readily available guide member, and a plurality of print pins arranged in said plurality of composite print pin holes to be selectively extendable beyond said print surface for printing, whereby said second section of said nose section provides guidance for the proper firing of said print pins.

54. The printhead in claim 53, wherein said second section is made up of a casting material which differs from the material of said first section.

55. The printhead in claim 54, wherein an undercut portion is provided between said first section and said second section, and said casting material fills said undercut portion.

56. The printhead in claim 54, wherein the casting material is Dentsply Triad.

57. The printhead in claim 53, wherein said second section forms at least a portion of said print surface, and said repaired print pin holes open at said print surface.

58. The printhead in claim 53, wherein said second section has at least one undercut portion which is below said first section, whereby said undercut portion serves to anchor said second section with respect to said first section.

59. The printhead in claim 53, wherein at least a portion of said composite print pin holes are arranged at angles to one another such that the print pins arranged therein will fire at angles to one another.

60. The printhead in claim 59, wherein said print pins are larger in cross-section than print pins of the spent printhead.

* * * * *